US009770802B2

(12) United States Patent
Inamori et al.

(10) Patent No.: US 9,770,802 B2
(45) Date of Patent: Sep. 26, 2017

(54) ROTARY DRESSER AND MANUFACTURING METHOD THEREFOR

(71) Applicant: ASAHI DIAMOND INDUSTRIAL CO., LTD., Tokyo (JP)

(72) Inventors: Kunihito Inamori, Kawasaki (JP); Manabu Sato, Ichihara (JP)

(73) Assignee: ASAHI DIAMOND INDUSTRIAL CO., LTD., Tokyo (JP)

( * ) Notice: Subject to any disclaimer, the term of this patent is extended or adjusted under 35 U.S.C. 154(b) by 211 days.

(21) Appl. No.: 14/355,013

(22) PCT Filed: Oct. 24, 2012

(86) PCT No.: PCT/JP2012/077492

§ 371 (c)(1),
(2) Date: Apr. 29, 2014

(87) PCT Pub. No.: WO2013/065551

PCT Pub. Date: May 10, 2013

(65) Prior Publication Data

US 2014/0302757 A1 Oct. 9, 2014

(30) Foreign Application Priority Data

Nov. 2, 2011 (JP) ..... P2011-241038

(51) Int. Cl.
*B24B 53/07* (2006.01)
*B24B 53/12* (2006.01)
(Continued)

(52) U.S. Cl.
CPC ..... *B24B 53/07* (2013.01); *B24B 53/062* (2013.01); *B24B 53/12* (2013.01); *B24D 3/06* (2013.01);
(Continued)

(58) Field of Classification Search
CPC .. B24B 53/07; B24D 3/00; B24D 5/00; B24D 5/06
See application file for complete search history.

(56) References Cited

U.S. PATENT DOCUMENTS 3,598,100 A * 8/1971 Deprez ..... B24B 53/07 125/11.03
6,074,278 A * 6/2000 Wu ..... B24D 5/04 451/28
(Continued)

FOREIGN PATENT DOCUMENTS

JP 5311112 B2 * 2/1976 ..... H01J 37/1472
JP S53-11112 B 4/1978
(Continued)

OTHER PUBLICATIONS

International Application No. PCT/JP2012/077492, International Search Report dated Dec. 18, 2012.
(Continued)

*Primary Examiner* — Larry E Waggle, Jr.
*Assistant Examiner* — Lauren Beronja
(74) *Attorney, Agent, or Firm* — Procopio, Cory, Hargreaves & Savitch LLP

(57) ABSTRACT

A rotary dresser includes a cored bar, an electroformed layer, and superabrasive grains fixed to an outer circumferential surface of the electroformed layer, and a plurality of island regions in which a plurality of superabrasive grains is gathered is provided at certain intervals. Since a plurality of the island regions in which a plurality of the superabrasive grains is gathered is provided at certain intervals, the same degree of dressing accuracy can be obtained as in a case in which expensive large superabrasive grains are fixed at a low density using cheap and small superabrasive grains, it is
(Continued)

possible to decrease the contact area of a single superabrasive grain, and favorable cutting quality can be obtained.

4 Claims, 18 Drawing Sheets

(51) Int. Cl.
*B24D 3/06* (2006.01)
*B24D 18/00* (2006.01)
*B24B 53/06* (2006.01)

(52) U.S. Cl.
CPC ..... *B24D 18/0009* (2013.01); *B24D 18/0018* (2013.01); *B24D 18/0072* (2013.01)

(56) References Cited

U.S. PATENT DOCUMENTS 6,106,382 A 8/2000 Sakaguchi
6,200,360 B1 3/2001 Imai et al.
6,419,574 B1 * 7/2002 Takahashi ..... B24B 53/017 451/443
2011/0073094 A1 * 3/2011 Tselesin ..... B24B 37/22 125/15

FOREIGN PATENT DOCUMENTS

| | | | | |
|---|---|---|---|---|
| JP | S56-163879 | B | | 12/1981 |
| JP | S60-183155 | B | | 12/1985 |
| JP | S64-051273 | B | | 2/1989 |
| JP | H10-006218 | B | | 1/1998 |
| JP | 11291169 | A | * | 10/1999 |
| JP | H11-291169 | B | | 10/1999 |
| JP | 2001-038630 | B | | 2/2001 |
| JP | 2007-021653 | B | | 2/2007 |
| JP | 2010-240795 | B | | 10/2010 |

OTHER PUBLICATIONS

International Application No. PCT/JP2012/077492, International Preliminary Report on Patentability dated May 6, 2014.

* cited by examiner

*Fig.15*

NORMAL DRESS RESISTANCE (N)

| | RIM SPEED RATIO | COMPARATIVE EXAMPLE | EXAMPLE |
|---|---|---|---|
| FEED SPEED 200 $\mu$ m/min | 0.25 | 14.6 | 13.2 |
| | 0.5 | 18.8 | 15.7 |
| | 0.75 | 21.5 | 15.9 |

*Fig.17*

NORMAL GRINDING RESISTANCE (N)

| | RIM SPEED RATIO | COMPARATIVE EXAMPLE | EXAMPLE |
|---|---|---|---|
| FEED SPEED 50 mm/min | 0.25 | 95.8 | 79.2 |
| | 0.5 | 62.7 | 49.0 |
| | 0.75 | 39.4 | 26.5 |

ROTARY DRESSER AND MANUFACTURING METHOD THEREFOR

TECHNICAL FIELD

An embodiment of the present invention relates to a rotary dresser used for dressing in which the state of a grinding wheel or a superabrasive grinding wheel such as a WA grinding stone and a GC grinding stone is adjusted through the rotation of the rotary dresser, and a manufacturing method therefore.

BACKGROUND ART

A rotary dresser is a rotating dresser having diamond abrasive grains implanted in and fixed to an outer circumferential surface. The rotary dresser is a tool to perform dressing while transferring the shape of the dresser to a grinding wheel or a superabrasive grinding wheel such as a WA grinding wheel or a GC grinding wheel by pressing the rotating rotary dresser against the grinding wheel. Since the rotary dresser can significantly shorten the dressing time, has high reproducibility of dressing accuracy, can easily procure high-degree automation, and can reduce the grinding cost, the rotary dresser has been widely used.

An electroforming rotary dresser is a dresser having diamond abrasive grains fixed using metal through an electroplating method. The electroforming rotary dresser can inverse the shape of an accurately finished matrix to the surface with no change, and therefore it is possible to produce products having a fine shape with high accuracy. For the electroforming rotary dresser, diamond abrasive grains are loaded onto the inner circumferential surface of the matrix, a layer of the diamond abrasive grains is preliminarily fixed to the inner circumferential surface of the matrix through electroplating, the remaining diamond abrasive grains are removed, and electroforming is additionally performed through electroplating, thereby fixing the diamond abrasive grains. Therefore, a layer of the diamond abrasive grains are densely loaded, and the degree of concentration becomes extremely high. Therefore, the intervals between the abrasive grains become narrow, the grinding wheel is not easily scratched, the abrasive grains form a flat state with a few scratch edges on the surface of the grinding wheel, and consequently, the grinding resistance becomes high, which has been a problem.

Therefore, several methods have been tested so far to adjust the degree of concentration of the diamond abrasive grains in the rotary dresser and to improve the performance. Patent Literature 1 discloses a technique in which an adhesive is applied to a wall surface of a matrix, a net having a mesh somewhat larger than the grain diameter of diamond abrasive grains is attached to the matrix, and the diamond abrasive grains are scattered onto the mesh in the net, thereby arraying and fixing the diamond abrasive grains in a lattice shape at intervals at which appropriate gaps are present between the grain diameters. In the above-described technique, only the diamond abrasive grains that have been inserted in the mesh are adhered and held through the adhesive, and other diamond abrasive grains are not adhered. Therefore, the diamond abrasive grains are regularly arrayed at a desired distribution density so that one diamond abrasive grain is present in one mesh.

CITATION LIST

Patent Literature

[Patent Literature 1] Japanese Unexamined Patent Application Publication No. 56-163879

SUMMARY OF INVENTION

Technical Problem

However, in the above-described technique, the intervals between the abrasive grains cannot be widened more than approximately the wire diameter of the mesh, and consequently, the number of the diamond abrasive grains that come into contact with a grinding wheel at contact portions at the same time increases while the grinding wheel is scratched, and it is not possible to expect significant improvement in cutting quality. In addition, use of large diamond abrasive grains and, furthermore, widening of the intervals between the abrasive grains can be considered to decrease the number of the diamond abrasive grains that come into contact at the same time; however, originally, large diamond abrasive grains are expensive, and therefore an increase in costs is caused. In addition, each of large diamond abrasive grains has a large contact area, and therefore favorable cutting quality cannot be obtained.

The embodiment of the invention has been made in consideration of the above-described problems, and an object of the invention is to provide a rotary dresser that can perform dressing with favorable cutting quality and favorable accuracy, and a manufacturing method therefor.

Solution to Problem

According to an embodiment of the invention, there is provided a rotary dresser including a cored bar that can rotate around a rotation axis; a bond layer on an outer circumferential side of the cored bar; and a plurality of superabrasive grains fixed on an outer circumferential surface of the bond layer, wherein a plurality of island regions in which a plurality of the superabrasive grains is gathered is provided at certain intervals on the outer circumferential surface of the bond layer.

According to the above-described configuration, a plurality of the island regions in which a plurality of the superabrasive grains is gathered is provided at certain intervals on the outer circumferential surface of the bond layer. Therefore, even when cheap and small superabrasive grains are used, the same degree of dressing accuracy can be obtained as in a case in which expensive large superabrasive grains are fixed at a low density, and it is possible to decrease the contact area of a single superabrasive grain, and therefore favorable cutting quality can be obtained. In addition, in a case in which superabrasive grains having the same grain diameter are used, even when the same number of the abrasive grains are present in the area of the outer circumferential surface, compared with a case in which the superabrasive grains are uniformly dispersed on the outer circumferential surface, it is possible to widen regions in which abrasive grains are not present and to improve cutting quality by increasing the intervals between the superabrasive grains in an island region and the superabrasive grains in the next island region during the rotation of the rotary dresser.

In addition, it is possible to dispose the island regions in a plurality of rows that inclines with respect to a rotation direction of the rotary dresser.

According to the above-described configuration, the island regions are disposed in a plurality of rows that inclines with respect to the rotation direction of the rotary dresser. Therefore, the time or distance required for the superabrasive grains in the island regions belonging to a row and the superabrasive grains in the island regions belonging to the next row to sequentially come into contact with a grinding wheel during the rotation of the rotary dresser becomes long, and it is possible to improve cutting quality.

In this case, it is possible to intermittently dispose each of the plurality of the rows of the island regions.

According to the above-described configuration, each of the plurality of the rows of the island regions is intermittently disposed.

Therefore, it becomes easy for the superabrasive grains in the island regions belonging to the respective rows to act on a grinding wheel at a variety of places on the outer circumferential surface, and it is possible to perform dressing with favorable accuracy.

In addition, it is possible to dispose the island regions in a zigzag shape in a direction orthogonal to the rotation direction.

According to the above-described configuration, the island regions are disposed in a zigzag shape in a direction orthogonal to the rotation direction. Therefore, it becomes easy for the superabrasive grains in the island regions to act on a grinding wheel at a variety of places on the outer circumferential surface, and it is possible to perform dressing with favorable accuracy.

In addition, it is possible to gather 2 to 15 superabrasive grains in the island region.

According to the above-described configuration, since 2 or more superabrasive grains are gathered in the island region, it is possible to form the island region using a plurality of cheap and small superabrasive grains. In addition, since 15 or less superabrasive grains are gathered in the island region, it is possible to prevent the presence of an excessive number of the superabrasive grains in the island region and an excessive increase in resistance during the dressing of a grinding wheel.

In addition, it is possible to set the total area of the island regions in a range of 30% to 80% of the total area of the outer circumferential surface of the bond layer.

According to the above-described configuration, since the total area of the island regions is 30% or more of the total area of the outer circumferential surface of the bond layer, the time or distance required for the superabrasive grains belonging to an island region and the superabrasive grains belonging to the next island region to sequentially come into contact with a grinding wheel becomes long, and therefore it is possible to improve cutting quality. In addition, since the total area of the island regions is 80% or less of the total area of the outer circumferential surface of the bond layer, it is possible to prevent an excessive increase in the area of the island regions and an excessive increase in resistance.

In addition, it is possible to undulate the outer circumferential surface of the bond layer in accordance with a desired shape of a grinding wheel to be dressed.

According to the above-described configuration, the outer circumferential surface of the bond layer is undulated in accordance with a desired shape of the grinding wheel to be dressed. In the embodiment of the invention, since it is easy to make the outer circumferential surface of the bond layer in a desired shape, it is possible to dress a grinding wheel in a desired shape with high accuracy by dressing the grinding wheel using the above-described rotary dresser.

In addition, according to another embodiment of the invention, there is provided a manufacturing method for a rotary dresser, in which a layer of superabrasive grains are preliminarily fixed to an inner circumferential surface of a matrix so that a plurality of island regions in which a plurality of the superabrasive grains is gathered is provided at certain intervals on the inner circumferential surface of the matrix, the preliminarily fixed superabrasive grains are fixed to the inner circumferential surface of the matrix through any of electroforming and sintering so as to form a superabrasive grain layer, a cored bar is inserted on an inner circumferential surface side of the matrix on which the superabrasive grain layer is formed, the superabrasive grain layer and the cored bar are joined together, and then the matrix is removed.

According to the above-described configuration, since it is possible to adjust the heights of the front ends of the superabrasive grains with high accuracy even in a case in which the grain diameters or shapes of the superabrasive grains are not uniform, it is possible to manufacture a rotary dresser which can perform dressing with favorable accuracy. In addition, in the rotary dresser to be manufactured, since a plurality of the island regions in which a plurality of the superabrasive grains is gathered is provided at certain intervals, cutting quality is favorable, and it becomes possible to perform dressing with favorable accuracy.

Advantageous Effects of Invention

According to the rotary dresser and the manufacturing method therefor of the embodiment of the invention, cutting quality is favorable, and it becomes possible to perform dressing with favorable accuracy.

BRIEF DESCRIPTION OF DRAWINGS

FIG. 15 is a table describing the normal dress resistance of an example and a comparative example.

FIG. 17 is a table describing the normal grinding resistance of the example and the comparative example.

DESCRIPTION OF EMBODIMENTS

Figure 1:
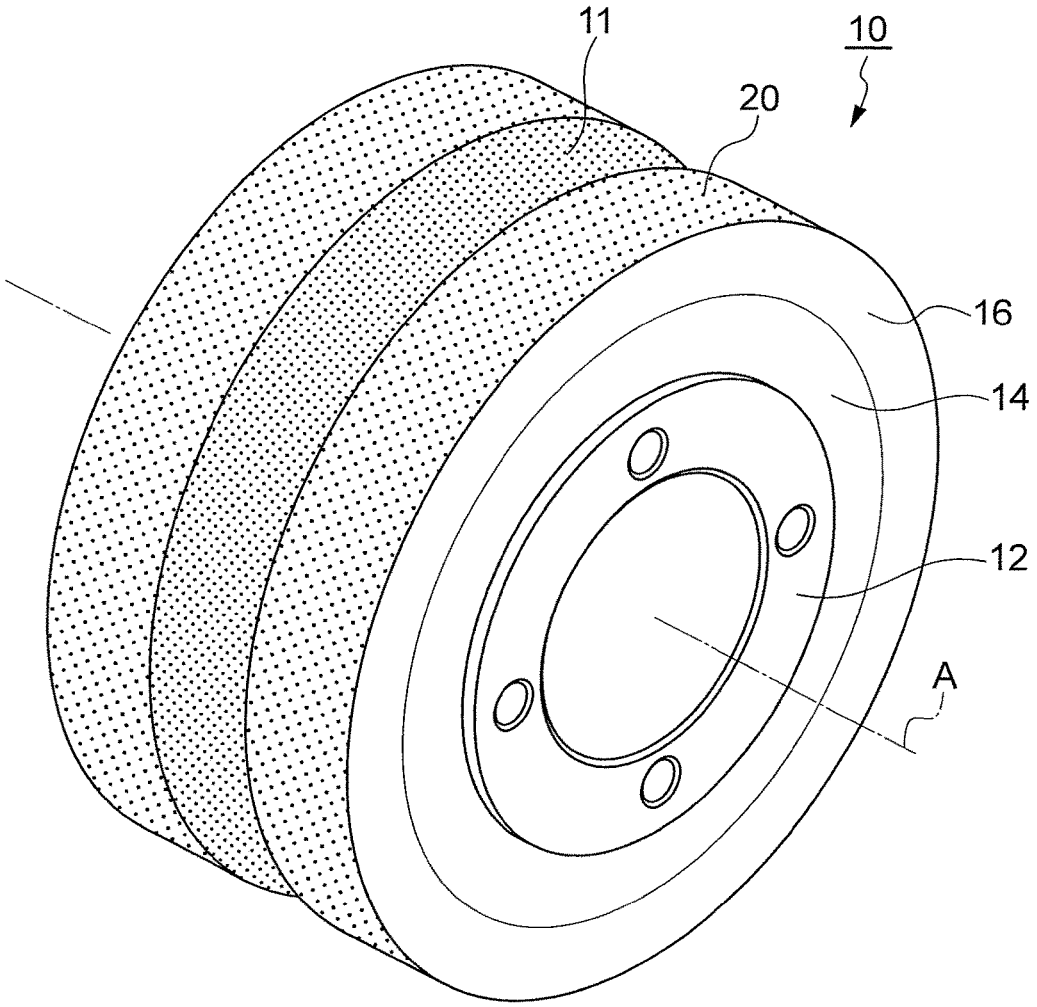
FIG. 1 is a perspective view illustrating a rotary dresser of a first embodiment.
Figure 2:
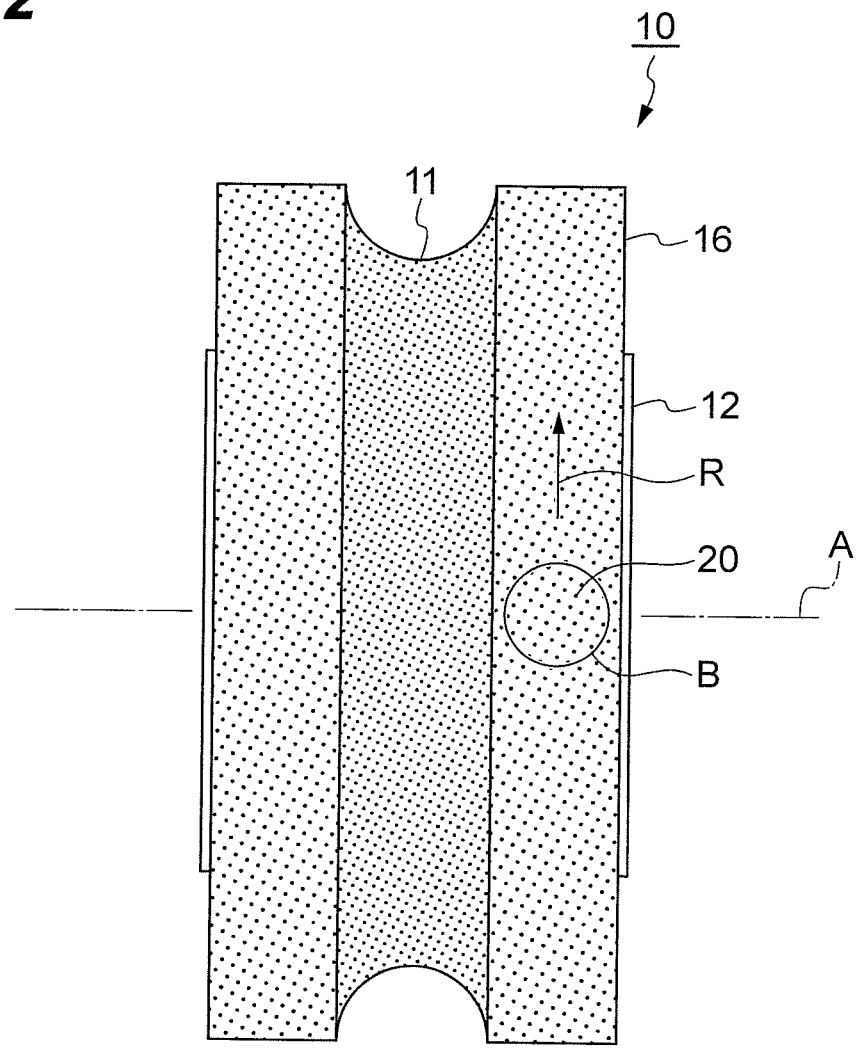
FIG. 2 is a front view illustrating the rotary dresser of the first embodiment.

An example of a rotary dresser according to an embodiment of the invention will be described with reference to the drawings. As illustrated in FIGS. 1 and 2, a rotary dresser 10 of a first embodiment of the invention includes a cored bar 12, a joining layer 14 and an electroformed layer 16, and a plurality of superabrasives 20 such as diamond and CBN is fixed to an outer circumferential surface of the electroformed layer. When the rotary dresser 10 of the embodiment is rotated in a rotation direction R, the superabrasives 20 dress a grinding wheel or a superabrasive grinding wheel such as a WA grinding wheel or a GC grinding wheel into a desired shape.

The cored bar 12 is a rotating body that rotates around a rotation axis A, is fixed to a rotation axis in an existing power tool, and is configured to be rotatable around the rotation axis A. The joining layer 14 is a layer made of a low-melting-point metal, and joins the cored bar 12 and the electroformed layer 16 as described below. The electroformed layer 16 is a layer formed by electroplating a metal such as Ni as described below. A plurality of the superabrasives 20 is fixed to the outer circumferential surface of the electroformed layer 16. In addition, the outer circumferential surface of the electroformed layer 16 is undulated by providing a recess portion 11 and the like in accordance with a desired shape of a grinding wheel to be dressed.

Figure 3:
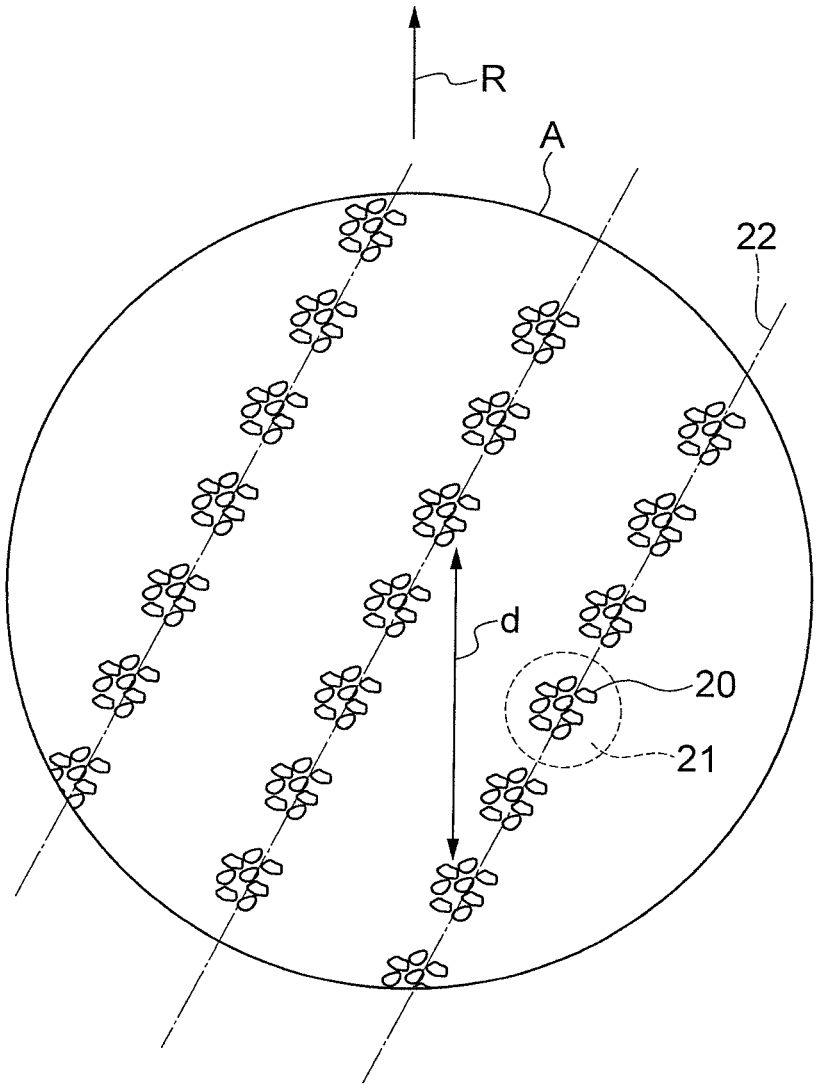
FIG. 3 is an enlarged view of a portion B in FIG. 2.

As illustrated in FIG. 3 that is an enlarged view of a B portion in FIG. 2, a plurality of island regions 21 in which 2 to 15 superabrasives 20 are gathered is provided at certain intervals on the outer circumferential surface of the electroformed layer 16. The island regions 21 are arrayed along a plurality of island region array lines 22 extending in an inclining manner with respect to the rotation direction R. The island region array lines 22 are provided at intervals of a predetermined distance d. The total area of the plurality of the island regions 21 is set in a range of 30% to 80% of the outer circumferential surface of the electroformed layer 16.

Figure 4:
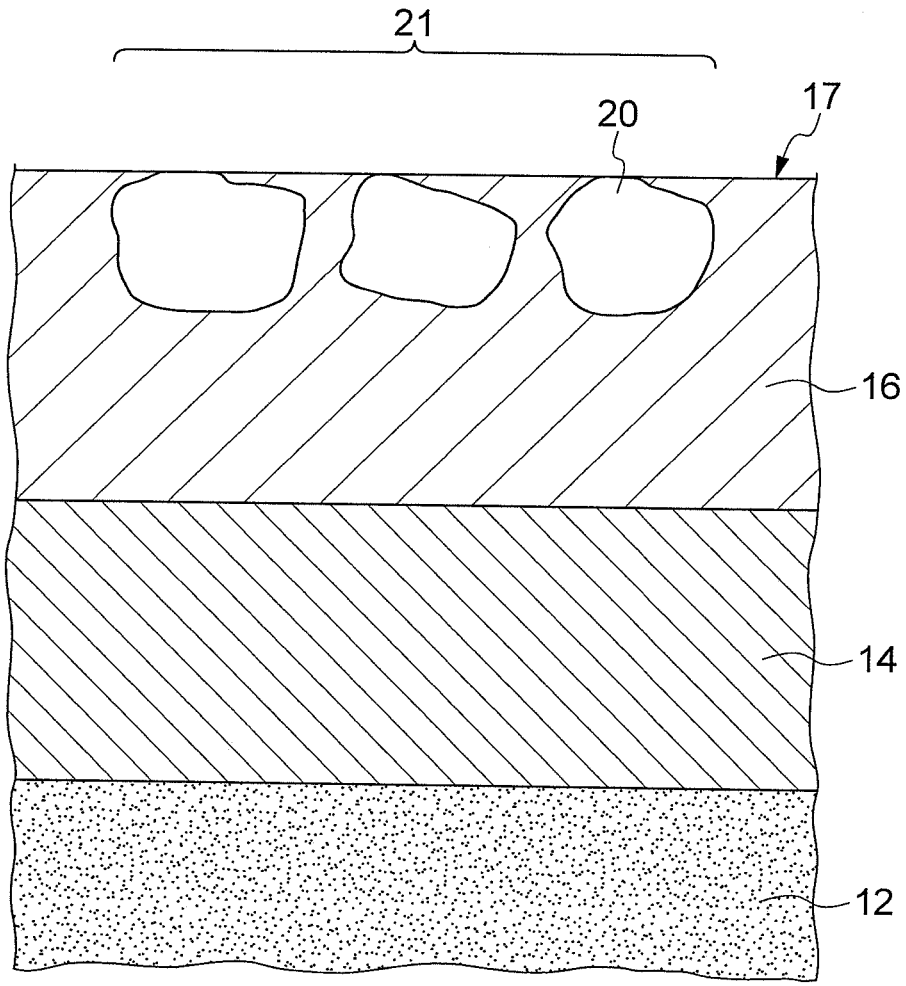
FIG. 4 is a vertical cross-sectional view of a vicinity of a circumferential surface of the rotary dresser of the first embodiment.
Figure 5:
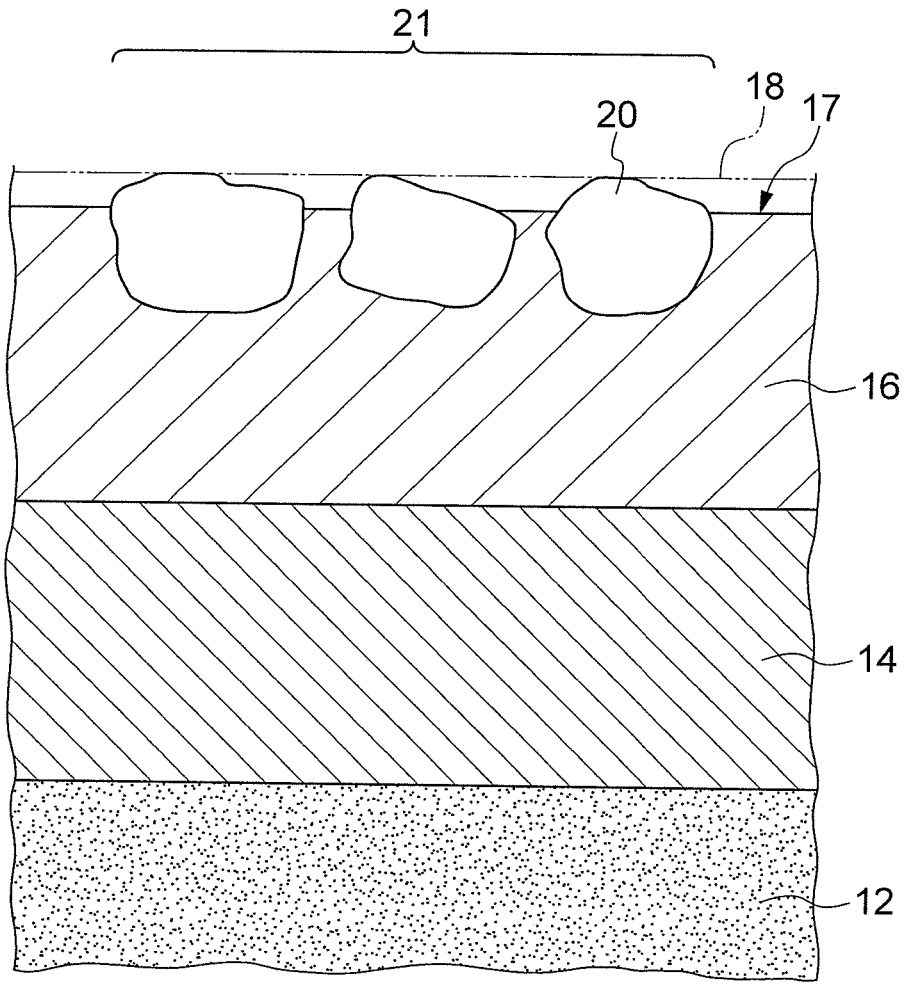
FIG. 5 is a vertical cross-sectional view illustrating the rotary dresser of FIG. 4 after exposing stones.

As illustrated in a cross-section of a vicinity of the outer circumferential surface of the electroformed layer 16 in FIG. 4, the rotary dresser 10 of the embodiment is configured by sequentially stacking the joining layer 14 and the electroformed layer 16 on an outer circumferential side of the cored bar 12. FIG. 4 illustrates an appearance of the rotary dresser immediately after removing a matrix described below. In this state, all the superabrasive grains 20 are fixed so that a portion of each superabrasive grain 20 located farthest from the rotation axis A (the cored bar 12 and the joining layer 14) is in contact with the outer circumferential surface 17 of the electroformed layer 16. When a grinding wheel is dressed using the rotary dresser 10 of the embodiment, the outer circumferential surface 17 of the electroformed layer 16 is slightly ground, and a state is formed in which front ends of the superabrasive grains 20 protrude from the outer circumferential surface 17 of the electroformed layer 16 as illustrated in FIG. 5.

Figure 6:
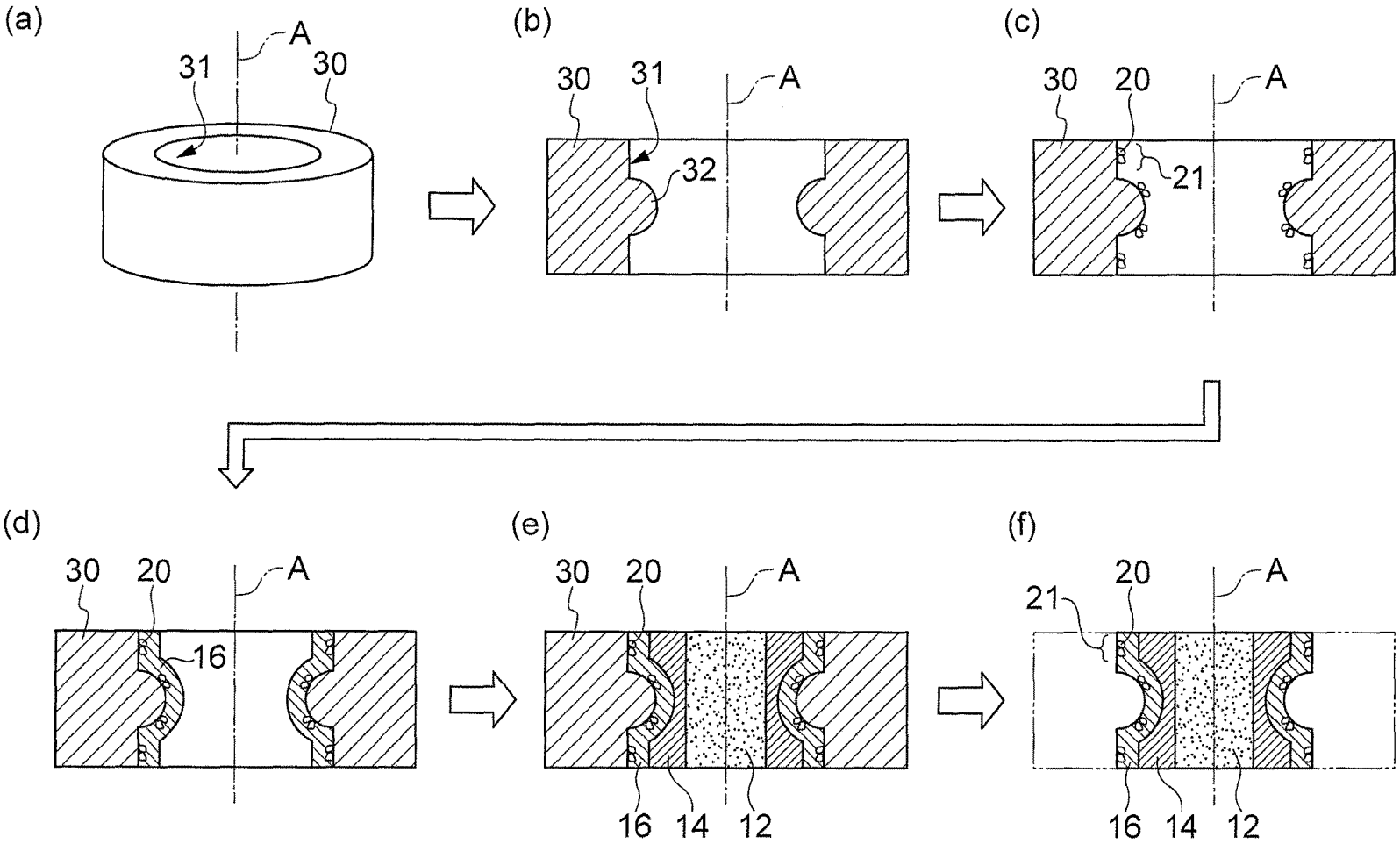
FIGS. 6(*a*) to 6(*f*) are views illustrating a manufacturing method for the rotary dresser of the first embodiment.

Hereinafter, a manufacturing method of the rotary dresser 10 of the embodiment will be described. A conductive matrix 30 as illustrated in FIG. 6(*a*) is prepared. The matrix 30 has an inner circumferential surface 31. The inner circumferential surface 31 is worked into a form as illustrated in FIG. 6(*b*), thereby forming a protrusion portion 32 matching the shape of the recess portion 11 of the rotary dresser 10 to be manufactured.

The superabrasive grains 20 are preliminarily fixed to the inner circumferential surface 31 of the matrix 30 so that the island regions 21 in which 2 to 15 superabrasive grains 20 are gathered are formed as illustrated in FIG. 6(*c*). In this case, the island regions 21 are formed along the island region array lines 22 illustrated in FIG. 3.

As illustrated in FIG. 6(*d*), the electroformed layer 16 is formed through electroplating. Then, since all the superabrasive grains 20 are preliminarily fixed to the inner circumferential surface 31 of the matrix 30, it is possible to adjust the heights of the front ends of the respective superabrasive grains 20 with high accuracy.

The cored bar 12 is inserted into an inner circumferential surface 31 side of the matrix 30, a molten low-melting-point metal is made to flow into a gap between the cored bar 12 and the electroformed layer 16 and cooled, thereby fixing the cored bar 12 and the electroformed layer 16 using the joining layer 14 as illustrated in FIG. 6(*e*). As illustrated in FIG. 6(*f*), the matrix 30 is removed, and the cored bar 12 is finished, thereby forming the rotary dresser 10. After that, the outer circumferential surface 17 of the electroformed layer 16 is ground so that the front ends of the superabrasive grains 20 are exposed as illustrated in FIG. 5, thereby completing the rotary dresser 10.

In the embodiment, the rotary dresser includes the cored bar 12 which can rotate around the rotation axis A, the electroformed layer 16 on the outer circumferential side of the cored bar 12, and a plurality of the superabrasive grains 20 fixed to the outer circumferential surface of the electroformed layer 16, and a plurality of the island regions 21 in which a plurality of the superabrasive grains 20 is gathered is provided at certain intervals on the outer circumferential surface 17 of the electroformed layer 16. Therefore, even when cheap and small superabrasive grains are used, the same degree of dressing accuracy can be obtained as in a case in which expensive large superabrasive grains are fixed at a low density, and it is possible to decrease the contact area of a single superabrasive grain, and therefore favorable cutting quality can be obtained. In addition, although the same number of the abrasive grains are present in the area of the outer circumferential surface, compared with a case in which the superabrasive grains are uniformly dispersed on and fixed to the outer circumferential surface, the time or distance required for the one superabrasive grain and the next superabrasive grain to sequentially come into contact with a grinding wheel during the rotation of the rotary dresser becomes long, and therefore it is possible to improve cutting quality.

In addition, the island regions 21 are disposed in a plurality of rows that inclines with respect to the rotation direction of the rotary dresser. Therefore, the time or distance d required for the superabrasive grains 20 in the island regions 21 belonging to a row and the superabrasive grains 20 in the island regions 21 belonging to the next row to sequentially come into contact with a grinding wheel during the rotation of the cored bar 12 becomes long, and therefore it is possible to improve cutting quality.

In addition, since 2 or more superabrasive grains 20 are gathered in the island region 21, it is possible to form the island region 21 using a plurality of cheap and small superabrasive grains 20. In addition, since 15 or less superabrasive grains 20 are gathered in the island region 21, it is possible to prevent the presence of an excessive number of the superabrasive grains 20 in the island region 21 and an excessive increase in resistance during the dressing of a grinding wheel 20.

In addition, since the total area of the island regions 21 is 30% or more of the total area of the outer circumferential surface 17 of the electroformed layer 16, the time or distance d required for the superabrasive grains 20 belonging to an island region 21 and the superabrasive grains 20 belonging to the next island region 21 to sequentially come into contact with a grinding wheel becomes long, and therefore it is possible to improve cutting quality. In addition, since the total area of the island regions 21 is 80% or less of the total area of the outer circumferential surface 17 of the electroformed layer 16, it is possible to prevent an excessive increase in the area of the island regions 21 and an excessive increase in resistance during the dressing of a grinding wheel.

In addition, the outer circumferential surface 17 of the electroformed layer 16 is undulated by providing the recess portion 11 and the like in accordance with a desired shape of a grinding wheel to be dressed. In the embodiment, since it is easy to make the outer circumferential surface 17 of the electroformed layer 16 in a desired shape, it is possible to dress a grinding wheel in a desired shape with high accuracy by dressing the grinding wheel using the rotary dresser 10.

Figure 7:
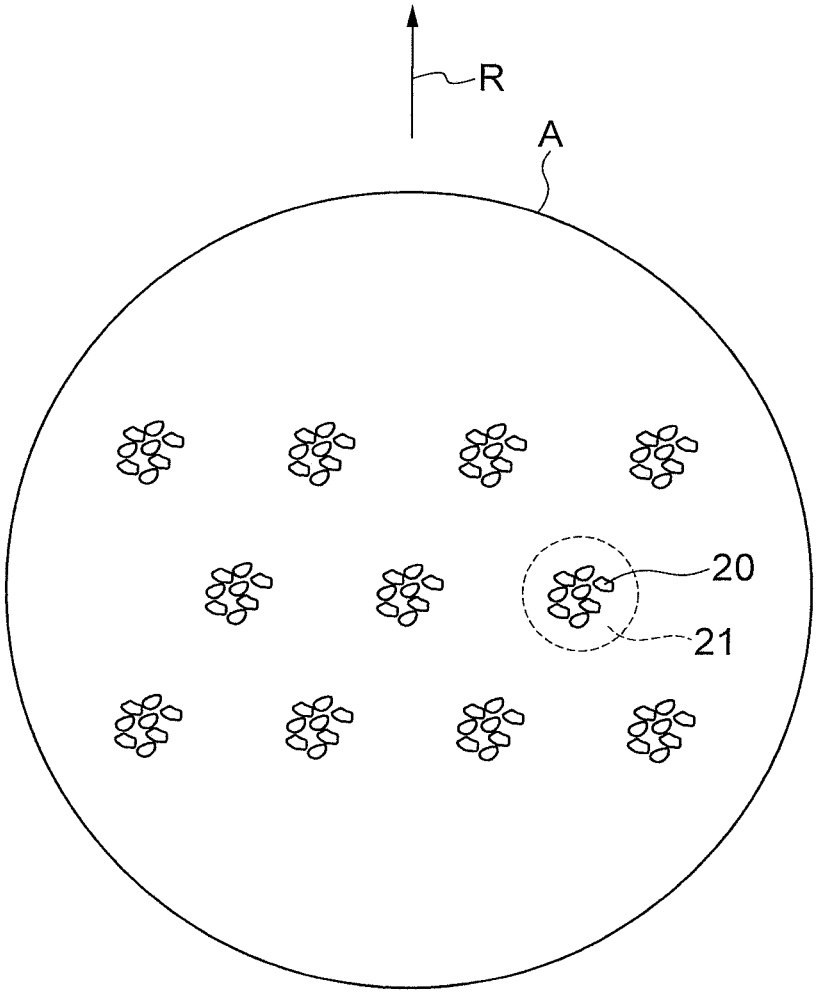
FIG. 7 is a view illustrating the disposition of superabrasive grains in a second embodiment.

Hereinafter, another embodiment of the invention will be described. In a second embodiment of the invention illustrated in FIG. 7, the island regions 21 are disposed in a zigzag shape. Therefore, it becomes easy for the superabrasive grains 20 in the island regions 21 to act on a grinding wheel at a variety of places on the outer circumferential surface 17, and it is possible to perform dressing with favorable accuracy.

Figure 8:
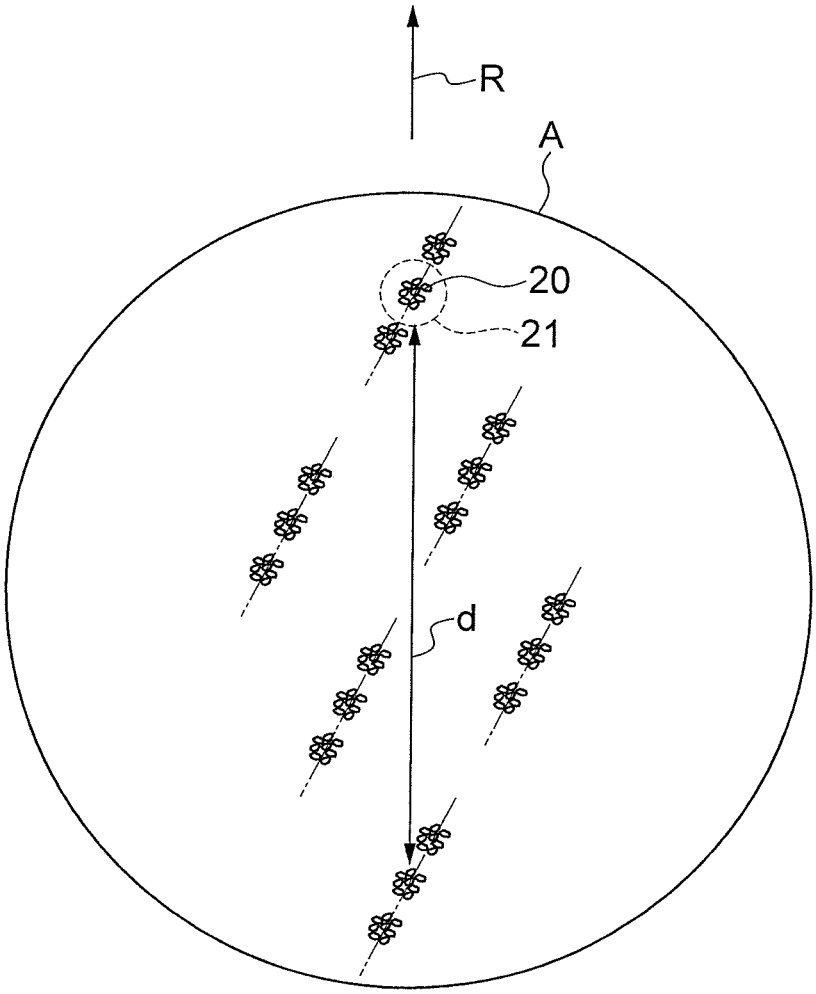
FIG. 8 is a view illustrating the disposition of superabrasive grains in a third embodiment.

In addition, in a third embodiment of the invention illustrated in FIG. 8, each of a plurality of the island regions 21 is long enough to traverse a part of the outer circumferential surface 17 of the electroformed layer 16. That is, rows of the island regions 21 are intermittently disposed. Therefore, the superabrasive grains 20 in the island regions 21 belonging to the respective rows act on a grinding wheel at a variety of places on the outer circumferential surface 17, and it is possible to perform dressing with favorable accuracy.

Figure 9:
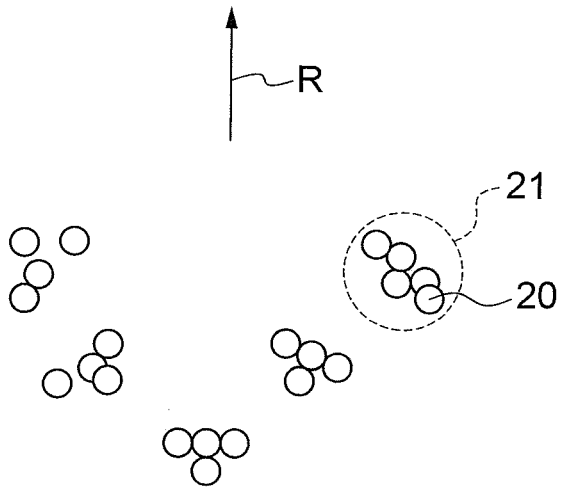
FIG. 9 is a view illustrating the disposition of superabrasive grains in a fourth embodiment.
Figure 10:
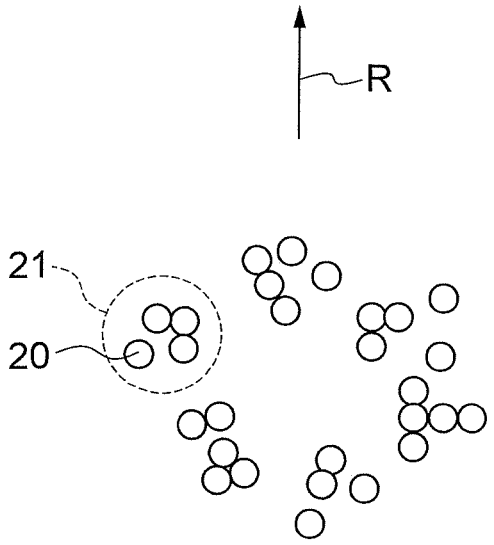
FIG. 10 is a view illustrating the disposition of superabrasive grains in a fifth embodiment.
Figure 11:
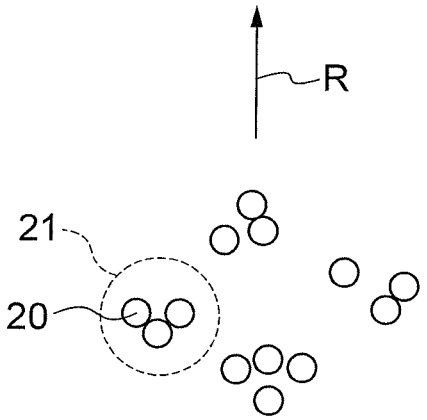
FIG. 11 is a view illustrating the disposition of superabrasive grains in a sixth embodiment.
Figure 12:
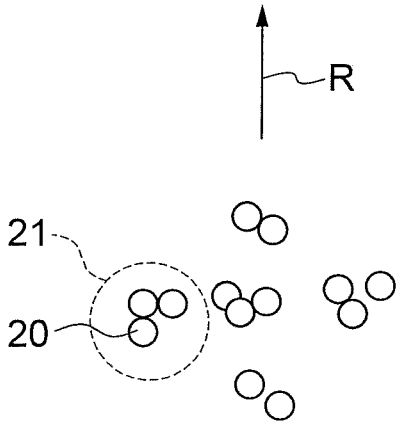
FIG. 12 is a view illustrating the disposition of superabrasive grains in a seventh embodiment.

In addition, in a fourth embodiment of the invention illustrated in FIG. 9, the island regions 21 are disposed in a V shape. In a fifth embodiment of the invention illustrated in FIG. 10, the island regions 21 are disposed in a round shape or an oval shape. In a sixth embodiment of the invention illustrated in FIG. 11, the island regions 21 are disposed in a rhomboid shape. In a seventh embodiment of the invention illustrated in FIG. 12, the island regions 21 are disposed in a cross shape. As described above, when the disposition of the island regions 21 is changed, it is possible to appropriately change the action on a grinding wheel.

Figure 13:
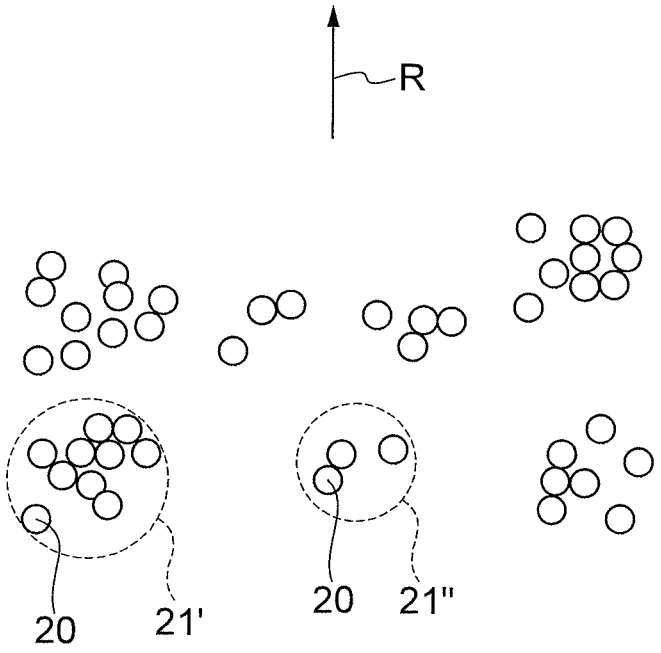
FIG. 13 is a view illustrating the disposition of superabrasive grains in an eighth embodiment.
Figure 14:
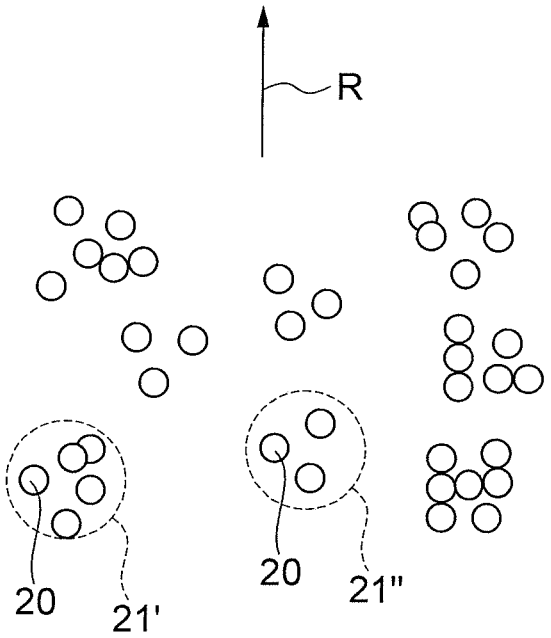
FIG. 14 is a view illustrating the disposition of superabrasive grains in a ninth embodiment.

In addition, in an eighth embodiment of the invention illustrated in FIG. 13, in an island region 21' and an island region 21", the area and the number of the superabrasive grains 20 in each of the island region 21' and the island region 21" are different. In addition, in a ninth embodiment of the invention illustrated in FIG. 14, in the island region 21' and the island region 21", the areas of the island region 21' and the island region 21" are equal, but the numbers of the superabrasive grains 20 are different. As described above, when the areas or the number of the superabrasive grains 20 in the island region 21' and 21" are different, it is possible to appropriately change the action on a grinding wheel in a selective manner at the respective portions on the outer circumferential surface 17 of the electroformed layer 16.

The invention is not limited to the above-described embodiments, and a variety of modified aspects are possible. For example, in the above-described embodiments, an aspect in which the superabrasive grains 20 are fixed to the electroformed layer 16 through electroplating has been mainly described. However, the rotary dresser of the invention can be applied to a sintered rotary dresser in which the superabrasive grains 20 are preliminarily fixed to the inner circumferential surface of the matrix 30 in an island shape in the same manner as in the above-described embodiments, then, a resin, metal powder or the like is made to flow in and sintered, thereby fixing the superabrasive grains 20.

Example 1

Hereinafter, an example of the invention will be described. A rotary dresser of the first embodiment of the invention illustrated in FIGS. 1 to 6 was manufactured. The rotary dresser was manufactured to have a diameter of 100 mm and a width of an outer circumferential surface of 30 mm. In addition, as a comparative example, a rotary dresser which, similarly to the example, had a diameter of 100 mm and a width of an outer circumferential surface of 30 mm, and had superabrasive grains uniformly fixed to an outer circumferential surface was prepared.

As grinding wheels to be dressed using the respective rotary dressers of the example and the comparative example, vitrified CBN wheels having a diameter of 200 mm and a width of an outer circumferential surface of 7 mm were prepared respectively. The dressing method was wet plunge dressing and down dressing in which the rotary dresser and the outer circumferential surface of the vitrified CBN wheel are rotated in the same direction. The dresser feed rate was 200 μm/min, and the rim speed of the rotary dresser was set to 503 m/min. The rim speed of the vitrified CBN wheel was set as described in the following (1) to (3). At this time, the normal dress resistance was measured using a piezoelectric dynamometer (manufactured by Kistler Japan Co., Ltd.).

(1) 2000 m/min, rim speed ratio (the rim speed of the rotary dresser/the rim speed of the vitrified CBN wheel)=0.25

(2) 1000 m/min, rim speed ratio (the rim speed of the rotary dresser/the rim speed of the vitrified CBN wheel)=0.5

(3) 667 m/min, rim speed ratio (the rim speed of the rotary dresser/the rim speed of the vitrified CBN wheel)=0.75

In addition, objects to be ground were ground respectively using the vitrified CBN wheels that had been dressed using the respective rotary dressers of the example and the comparative example. The grinding method was wet creep feed grinding. The rim speeds of the vitrified CBN wheels were set to 2000 m/min. The feed speeds of the objects to be ground were set to 50 mm/min. The scratching amount was set to 0.5 mm. As the objects to be ground, SKH-51 (Japanese Industrial Standards), which was high-speed tool steel, having Rockwell Hardness (HRC) of 60 was prepared. At this time, the normal grinding resistance was measured using a piezoelectric dynamometer (manufactured by Kistler Japan Co., Ltd.).

Figure 16:
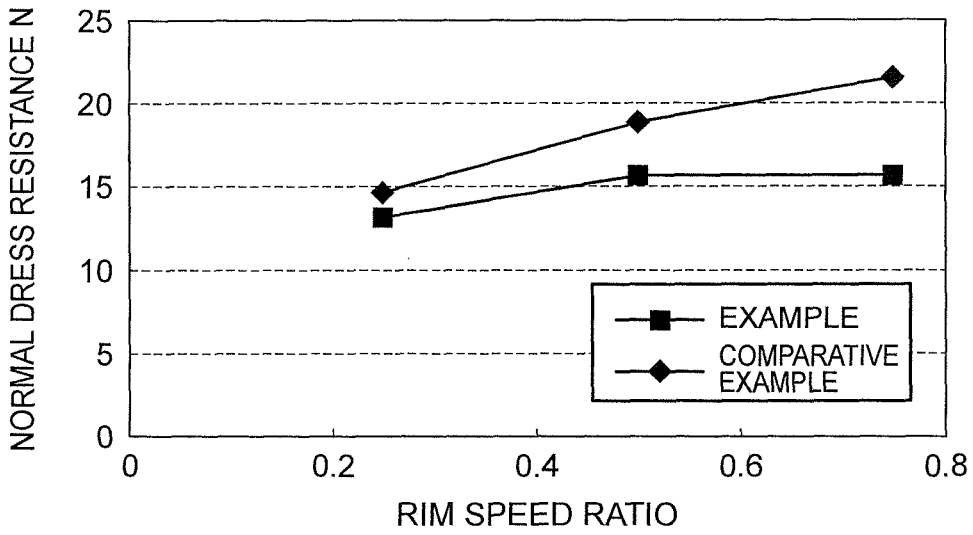
FIG. 16 is a graph illustrating the normal dress resistance of the example and the comparative example.
Figure 18:
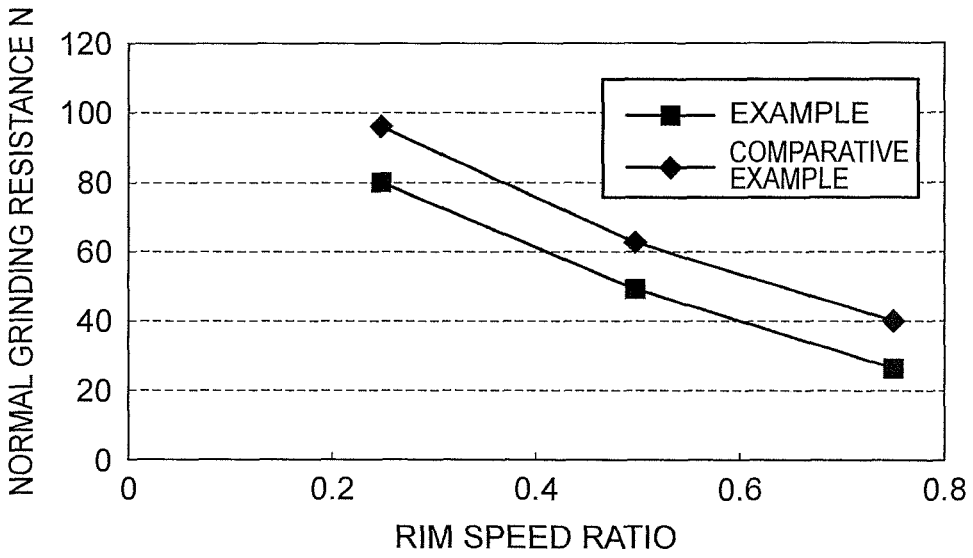
FIG. 18 is a graph illustrating the normal grinding resistance of the example and the comparative example.

As illustrated in FIGS. 15 and 16, it is found that the normal dress resistance of the rotary dresser of the example was decreased more than of the comparative example, and the cutting quality improved in all the rim speeds ratios between the rotary dresser and the vitrified CBN wheel. In addition, as illustrated in FIGS. 17 and 18, it is found that the normal grinding resistance of the vitrified CBN wheel dressed using the rotary dresser of the example was decreased more than that of the comparative example, and the cutting quality of the vitrified CBN wheel dressed using the rotary dresser also improved.

INDUSTRIAL APPLICABILITY

According to the rotary dresser and the manufacturing method therefor according to the embodiment of the invention, it becomes possible to perform dressing with favorable cutting quality and favorable accuracy.

REFERENCE SIGNS LIST

10 ROTARY DRESSER
11 RECESS PORTION
12 CORED BAR
14 JOINING LAYER
16 ELECTROFORMED LAYER
17 OUTER CIRCUMFERENTIAL SURFACE
18 IMAGINARY CIRCUMFERENTIAL SURFACE
20 SUPERABRASIVE GRAIN
21, 21', 21" ISLAND REGION
22 ISLAND REGION ARRAY LINE
30 MATRIX
31 INNER CIRCUMFERENTIAL SURFACE
32 PROTRUSION PORTION
A ROTATION AXIS
R ROTATION DIRECTION
d DISTANCE

The invention claimed is:

1. A rotary dresser, comprising:

a cored bar that can rotate around a rotation axis and is a rotating body that rotates around the rotation axis;

a joining layer stacked on an outer circumferential side of the cored bar;

an electroformed layer stacked on an outer circumferential side of the cored bar; and a plurality of superabrasive grains fixed on an outer circumferential surface of the electroformed layer, wherein all of the plurality of superabrasive grains are fixed so that a portion of each one of the plurality of superabrasive grains that is located farthest from the joining layer is in contact with the outer circumferential surface of the electroformed layer, wherein a plurality of island regions in which a plurality of the superabrasive grains is gathered is provided at certain intervals on the outer circumferential surface of the electroformed layer so that the island regions do not contact each other, wherein the island regions are disposed in a plurality of rows that incline with respect to a rotation direction of the rotary dresser on the outer circumferential surface of the electroformed layer, wherein island region array lines are provided at intervals of a distance so that the island regions disposed in the different rows do not contact each other, and wherein a distance between the outer circumferential surface of the electroformed layer and the joining layer in the island region is equal to a distance between the outer circumferential surface of the electroformed layer and the joining layer in a region except for the island region.

2. The rotary dresser according to claim 1, wherein each of the plurality of the rows of the island regions along the plurality of island region array lines is intermittently disposed.

3. The rotary dresser according to claim 1, wherein 2 to 15 superabrasive grains are gathered in each island region.

4. The rotary dresser according to claim 1, wherein the outer circumferential surface of the electroformed layer is undulated in accordance with a desired shape of a grinding wheel to be dressed.

* * * * *